US007441567B2

(12) United States Patent
Zorini

(10) Patent No.: US 7,441,567 B2
(45) **Date of Patent: *Oct. 28, 2008**

(54) NEEDLE LOOM WITH AUTOMATIC CHANGE OF THE WEFT THREAD

(76) Inventor: Luigi Omodeo Zorini, c/o Comez S.p.A., Via Enrico Fermi 5, P.O. Box 5, 27024, Cilavegna (Pavia) (IT)

( * ) Notice: Subject to any disclaimer, the term of this patent is extended or adjusted under 35 U.S.C. 154(b) by 1 day.

This patent is subject to a terminal disclaimer.

(21) Appl. No.: 11/582,752

(22) Filed: Oct. 18, 2006

(65) Prior Publication Data

US 2007/0089799 A1 Apr. 26, 2007

(30) Foreign Application Priority Data

Oct. 20, 2005 (EP) ..... 05425736

(51) Int. Cl.
*D03D 47/00* (2006.01)
*D04B 25/02* (2006.01)

(52) U.S. Cl. ..... 139/449; 139/429; 139/440; 139/441; 139/442; 139/11; 139/116.1; 66/81; 66/204; 66/82 A

(58) Field of Classification Search ..... 139/429, 139/440–442, 449, 11, 116.1; 66/81, 204, 66/82 A See application file for complete search history.

(56) References Cited

U.S. PATENT DOCUMENTS 3,519,029 A * 7/1970 Villa Carlo et al. ..... 139/431
6,112,775 A * 9/2000 Hossli et al. ..... 139/383 R
6,381,818 B1 * 5/2002 Freeman et al. ..... 28/107
6,959,566 B2 * 11/2005 Zorini et al. ..... 66/204
6,962,172 B2 * 11/2005 Zorini et al. ..... 139/429
7,073,540 B2 * 7/2006 Zorini ..... 139/449
2005/0066693 A1 * 3/2005 Zorini et al. ..... 66/81
2005/0086978 A1 * 4/2005 Zorini et al. ..... 66/203
2005/0284186 A1 * 12/2005 Zorini ..... 66/7
2006/0169003 A1 * 8/2006 Zorini ..... 66/85 R

FOREIGN PATENT DOCUMENTS

EP 0 461 524 A1 12/1991
EP 0 896 075 A2 2/1999
EP 1 353 000 A1 10/2003
EP 1 609 900 A1 12/2005
JP 09 217248 A 8/1997

* cited by examiner

*Primary Examiner*—Bobby H Muromoto, Jr.
(74) *Attorney, Agent, or Firm*—Pearne & Gordon LLP

(57) ABSTRACT

A needle loom is provided with a bearing structure (2), one textile-product (P) forming head (3) installed on the bearing structure (2), two heddle frames (6) capable of intercepting a plurality of warp threads (O), one sickle (9) to bring the two weft threads (T) transversely between the warp threads (O), two movable guides (11) each of which is adapted to intercept one of the weft threads (T), actuators (13) to shift the movable guides (11) and change the weft threads (T) carried by the sickle (9), one needle (18) to temporarily retain at least one of the two weft threads (T) carried by the sickle (9), and a reed (20) to compact the weft threads (T) against the already formed textile product (P). Two electric motors (21), each of which is connected to a respective guide (11) actively move the respective guide (11) in a first way (X) or in a second way (Y) along the predetermined direction (D), upon command of the respective motor (21).

15 Claims, 11 Drawing Sheets

FIG 10
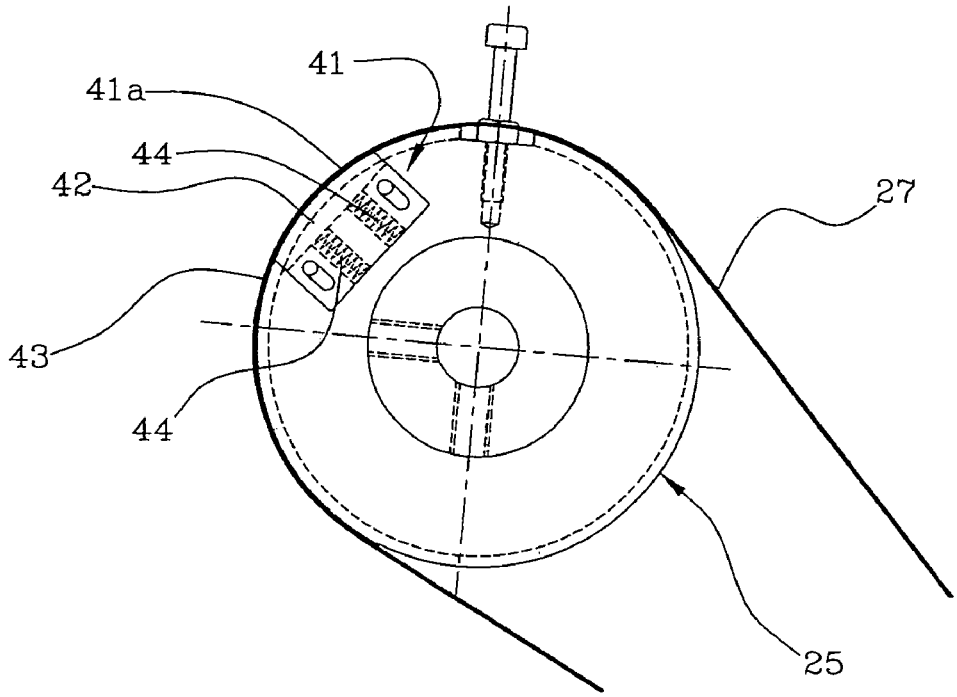
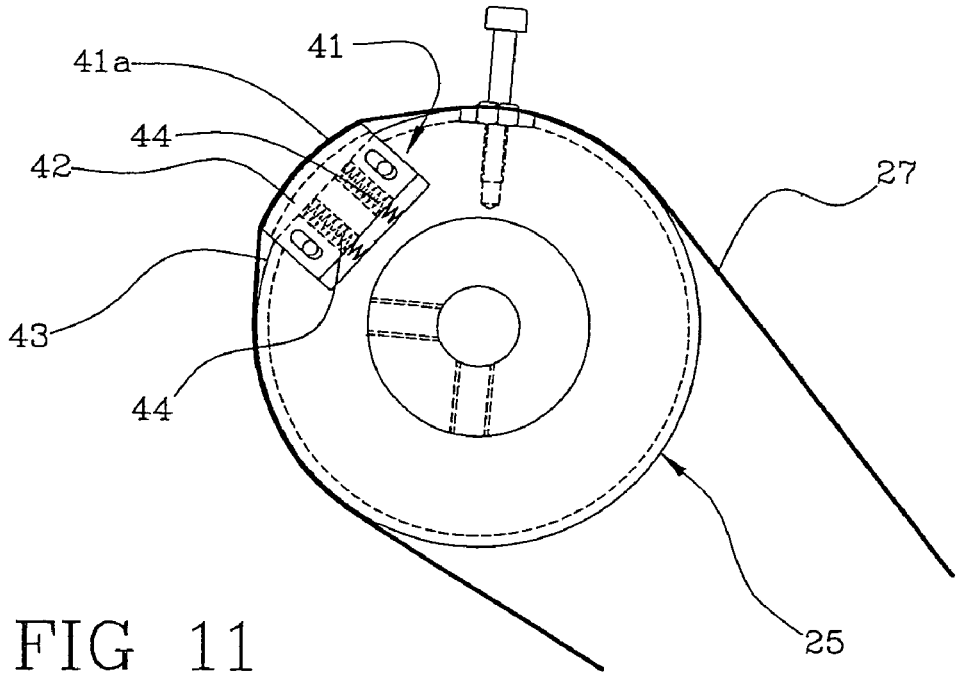
FIG 11

NEEDLE LOOM WITH AUTOMATIC CHANGE OF THE WEFT THREAD

The present invention relates to a needle loom with automatic change of the weft thread.

In textile machines, fabric formation takes place through mutual interlacing of a plurality of warp and weft threads that are suitably engaged by respective weaving members.

It is known that textile machines referred to as needle looms comprise one or more textile-product forming heads at which interlacing occurs between the warp threads coming from respective beams installed on a rack referred to as "creel", and the weft threads unwound from respective bobbins mounted on a creel dedicated thereto and fed by suitable devices. Needle looms are concerned with manufacture of textile products of an indefinite length but of reduced width in the order of few centimetres, such as ribbons, tapes, shoulder straps, etc.

Each forming head substantially comprises a bearing plate defining the forming plane of the textile product, at least one pair of heddle frames (harness) that are used to alternately lift and lower the warp threads fed to the bearing plate, a sickle bringing one or more weft threads between the warp threads in a direction transverse to the warp threads themselves, a needle adapted to retain the weft threads before they are tied between the warp threads by effect of the harness motion, and a reed compacting the weft threads on the already formed textile product after each passage of the sickle. Suitable means, disposed downstream of the forming station, keep the textile product stretched and enable the same to exit the loom.

Needle looms are known that are able to supply the sickle with two or more weft threads, of different colours and materials, and to select which of said threads is to be included in the fabric at each passage of the sickle itself. Needle looms of this type allow ribbons with multicoloured transverse stripes to be manufactured.

To this aim, the looms of the known art are provided with a particular guide device placed upstream of the sickle and allowing each of the weft threads to be moved in a vertical direction between an active position at which it is hooked by the sickle, and a passive position at which the sickle is not able to intercept it.

The guide device is located close to the bearing plate and the reed and comprises as many movable guides as the weft threads. Each guide is provided with an eyelet through which the weft thread passes before reaching the sickle. Each guide is vertically movable usually between a lower position, an intermediate position and an upper position. The sickle has a hook in which the weft thread is engaged when the latter is brought to the intermediate position by a movable guide while the other guides are in one of the end positions.

Movement of the guides in accordance with the known art is obtained through complicated motion-transmitting mechanisms connected to the main drive shaft of the needle loom and capable of converting the periodic motion of the shaft into distinct but correlated movements of the individual guides.

The motion-transmitting mechanisms of known type are formed of mechanical transmissions and/or magnetic actuators capable of hooking or releasing one of the guides based on the angular work step of the drive shaft. As a consequence thereof, in most of known needle looms, the motion law of the guides cannot be varied otherwise than planning the whole motion-transmitting mechanism again.

Also known are needle looms capable of obviating this drawback by moving the guides in an independent manner. In particular, as disclosed in the European Patent Application EP1353000, there are needle looms provided with an electric motor associated with each individual movable guide. Each electric motor has a rotating shaft coupled with a connecting cable in engagement with an upper end of a respective guide.

By driving one of the motors in rotation in a predetermined direction, the respective guide is pulled upwards through the connecting cable and brings the weft thread to the active position at which it is hooked by the sickle.

The guide is further associated with a return spring coaxial with the guide, which spring is compressed on lifting of the guide itself by the motor. When the guide has to put the weft thread back to the passive position, the motor rotates in the opposite direction and releases the connecting cable while the spring extends and exerts a return action capable of lowering the guide.

While this type of loom allows movements of the movable guides to be easily changed so as to consequently change distribution of the weft in the fabric during working, it too has important drawbacks. These drawbacks are connected with the return movement of the guides carried out by means of springs.

Firstly it is to be pointed out that after a predetermined number of work cycles the springs lose their resilient features until reaching a yield condition which will give rise, as a result, to damaging of the guide movement and to the necessity to inevitably replace the springs themselves.

A further drawback resides in that, in the presence of too stiff springs as required for obtaining high work speeds, electric motors of big sizes and therefore very bulky and expensive are to be used. If, on the contrary, springs of reduced stiffness are used, the guide return has an insufficient speed.

In addition, the springs may begin vibrating causing vibration of the whole guide to such an extent that the weft thread is not disposed in a correct manner in the finished product.

Finally, a further and important drawback-of the known art is represented by the fact that the guide return speed cannot be varied during a work cycle, because this speed exclusively depends on the mechanical features of the respective spring.

From the above it appears that the looms of the known art lack versatility, in particular in relation to the movement control of the weft threads.

Accordingly, the present invention aims at eliminating the above mentioned drawbacks by providing a needle loom with automatic change of the weft thread which is more versatile than known looms.

In particular, it is an aim of the present invention to provide a needle loom enabling the movement of the guide to be adjusted and controlled in both directions.

It is a further aim of the present invention to conceive a needle loom with automatic change of the weft thread that is provided with guide actuating means of simple and reliable construction.

The foregoing and other aims are substantially achieved by a needle loom with automatic change of the weft thread comprising the features set out in one or more of the appended claims.

Description of a preferred embodiment of a needle loom with automatic change of the weft thread is now given hereinafter by way of non-limiting example, in which.

Figure 2:
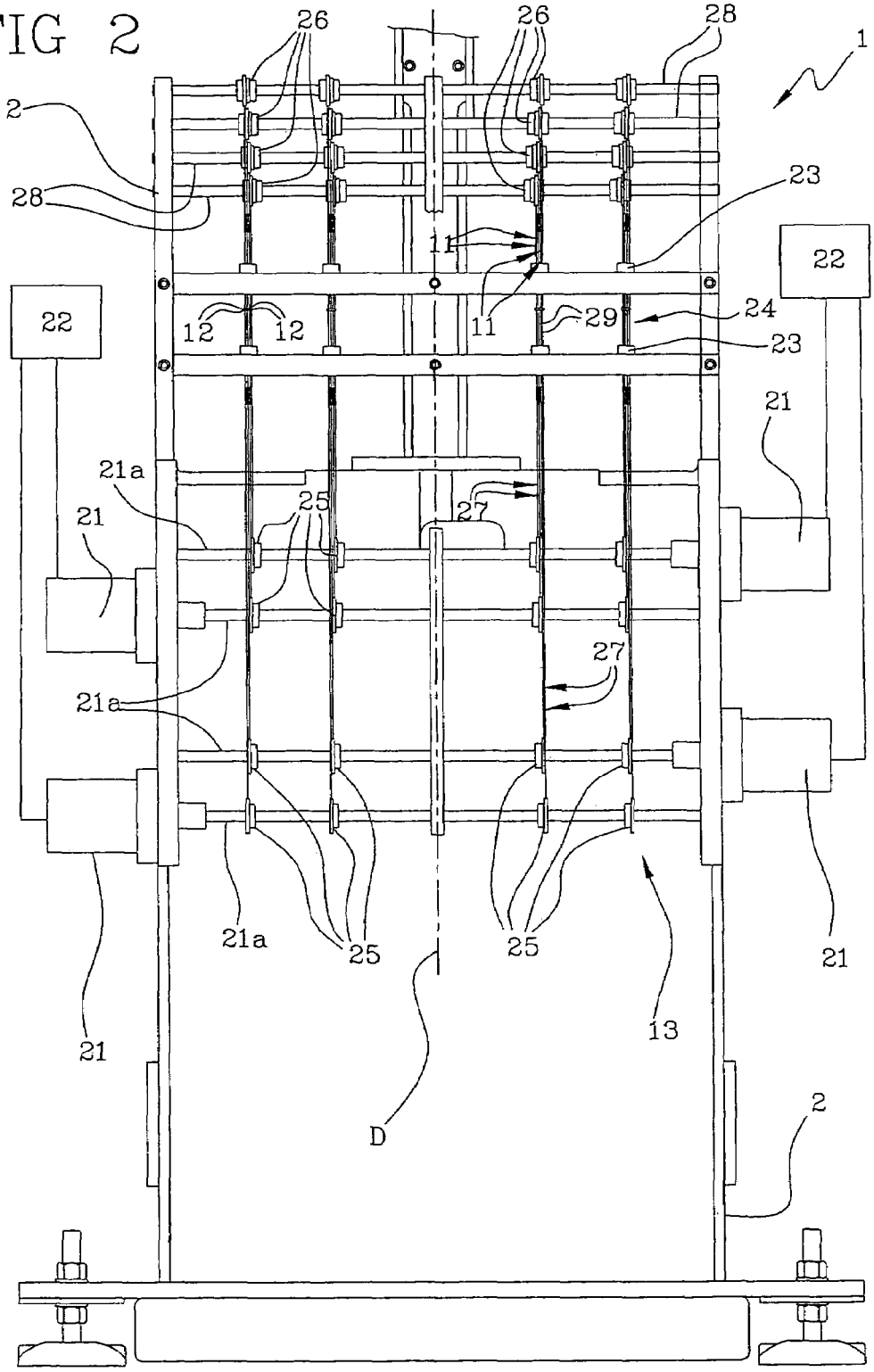
FIG. 2 is a diagrammatic front elevation view with some parts removed for a better view of others, of a first embodiment of the loom in accordance with the present invention.
Figure 2A:
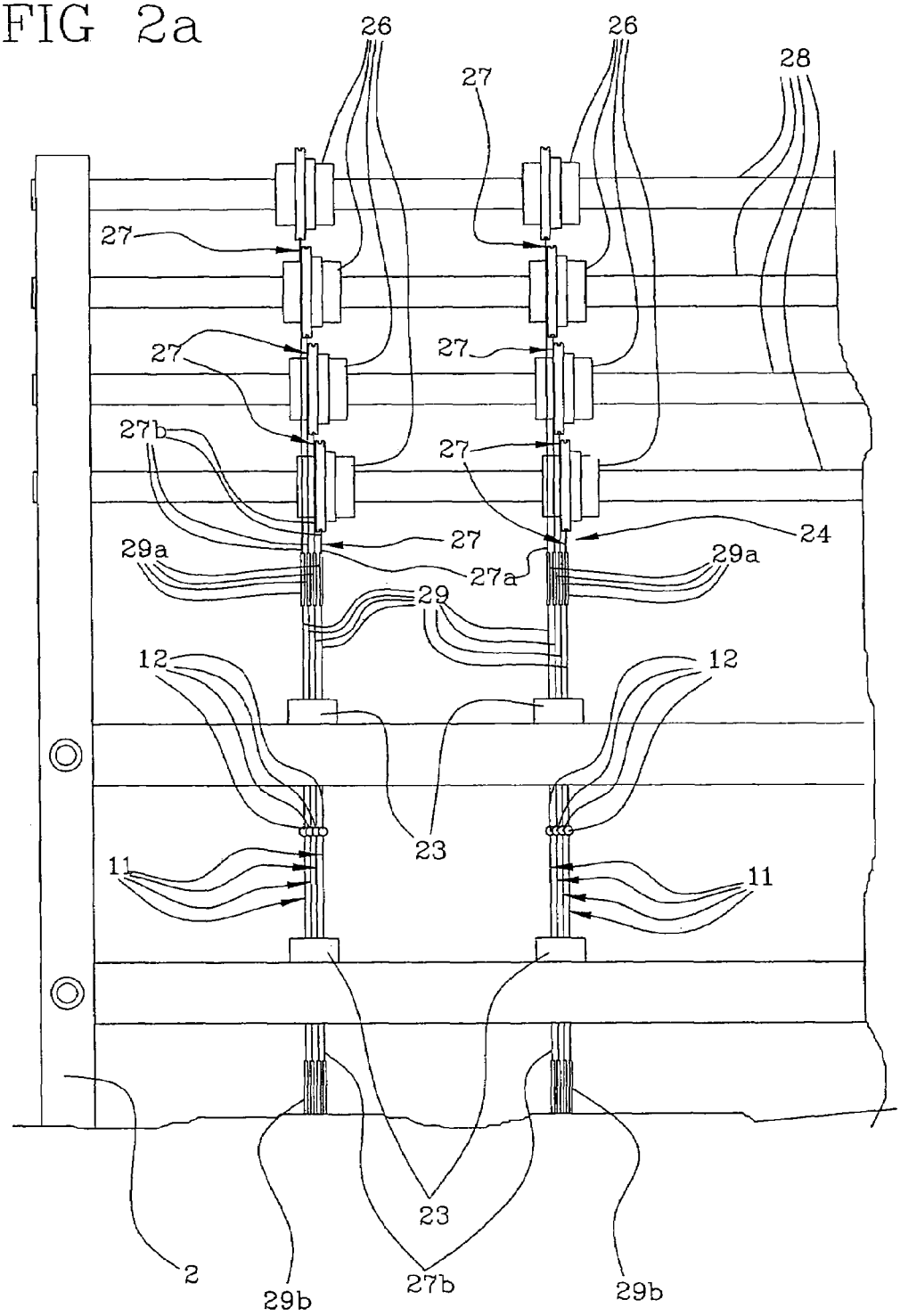
Figure 3:
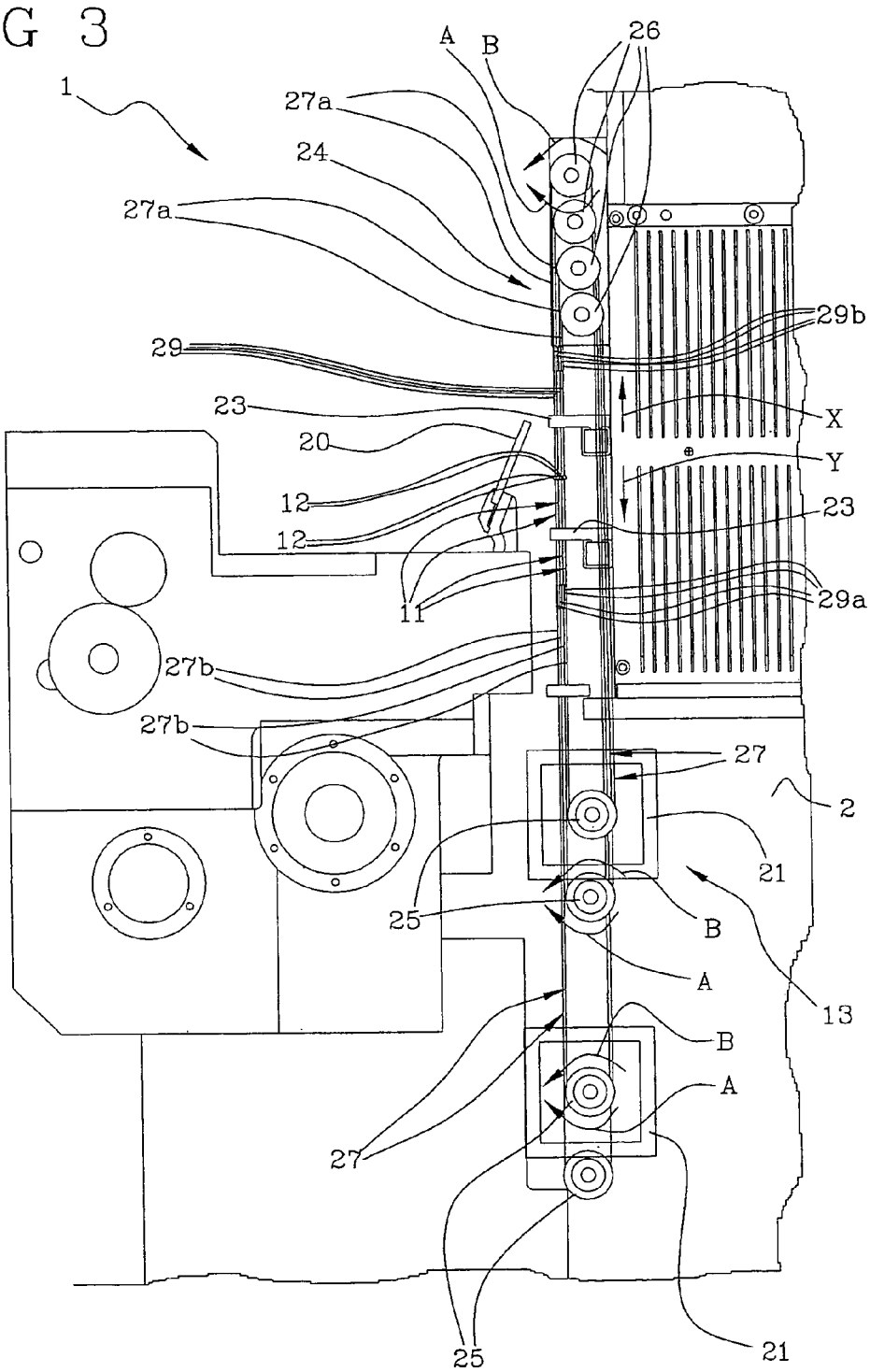
Figure 4:
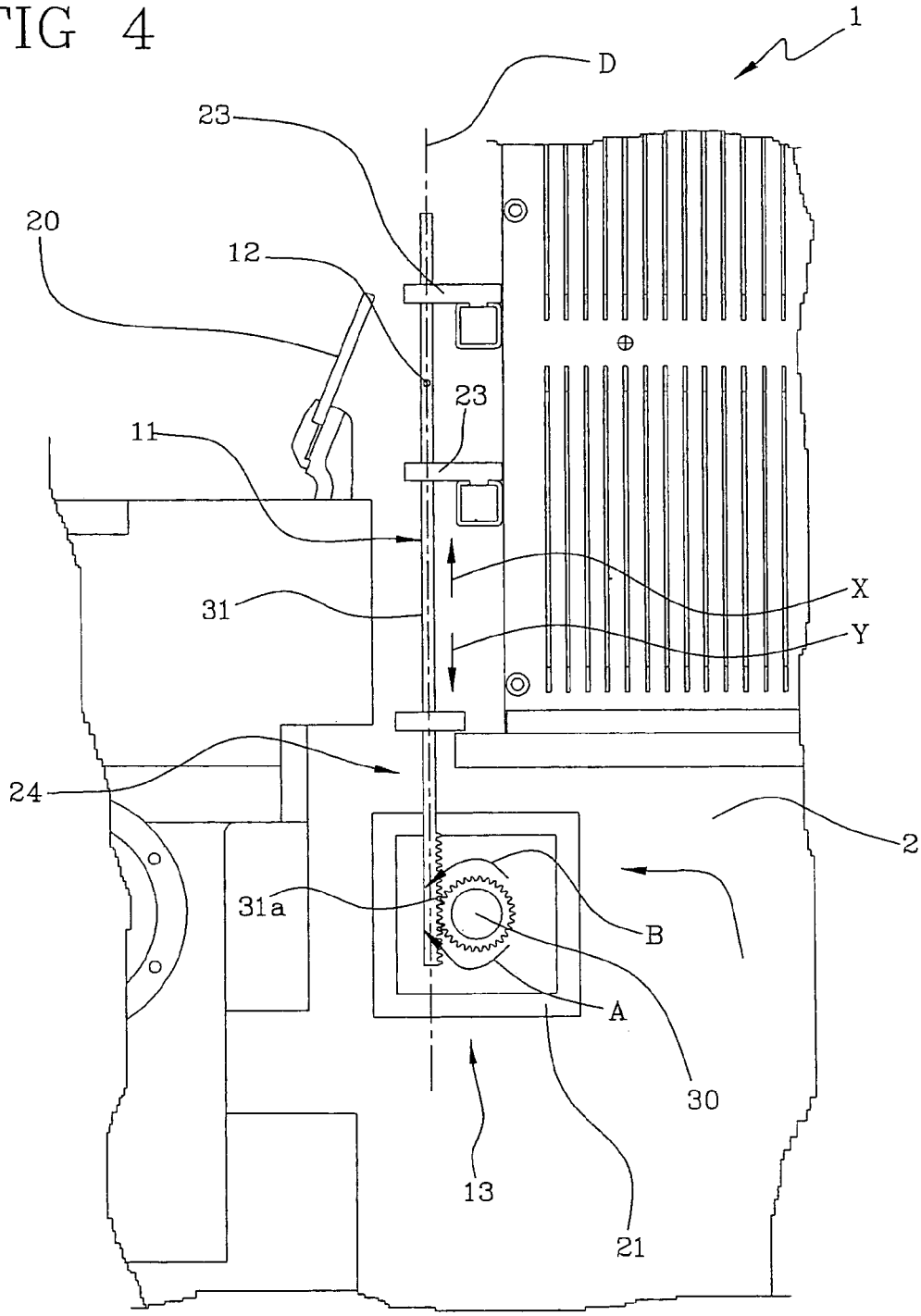
Figure 5:
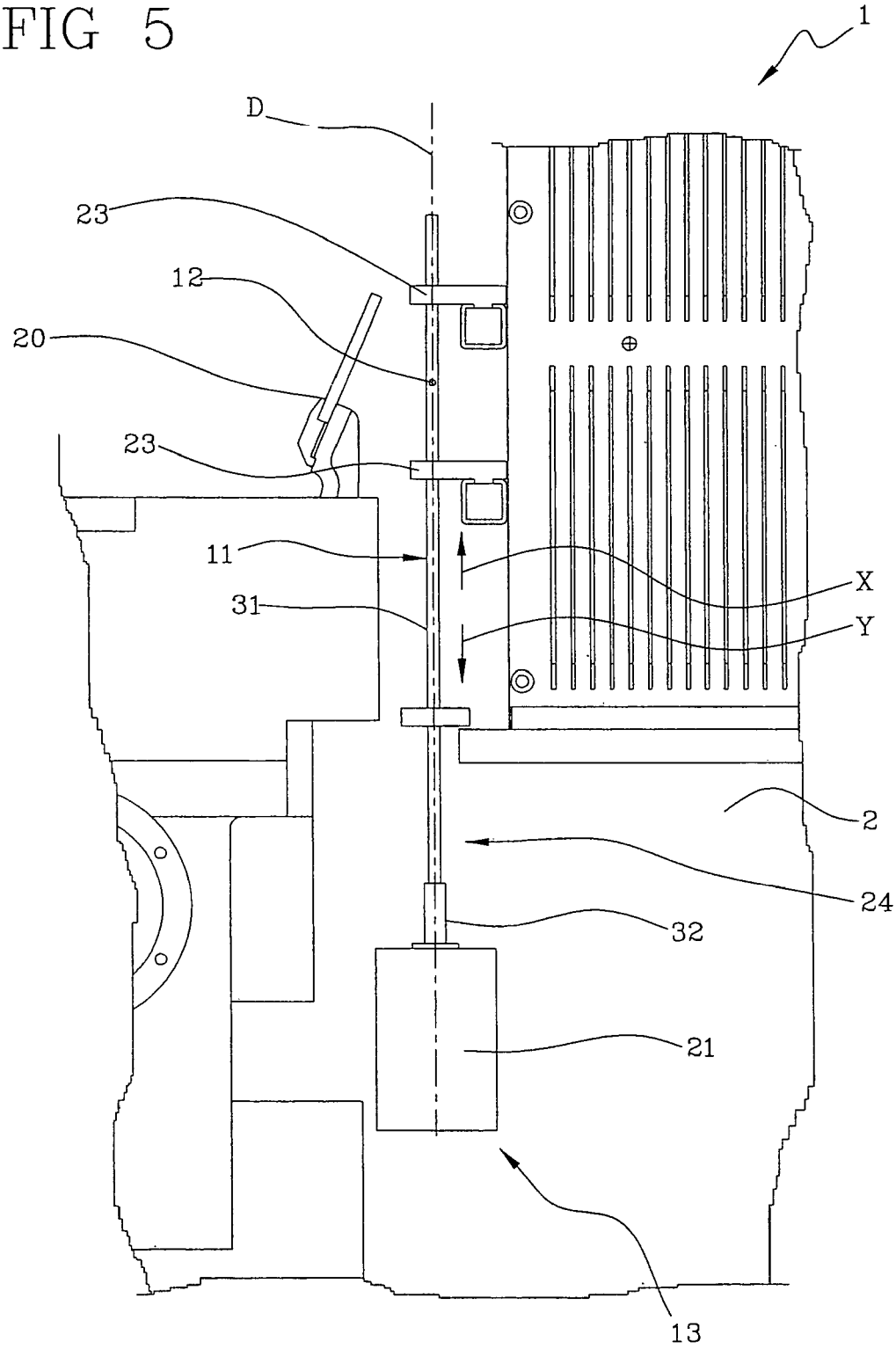
Figure 6:
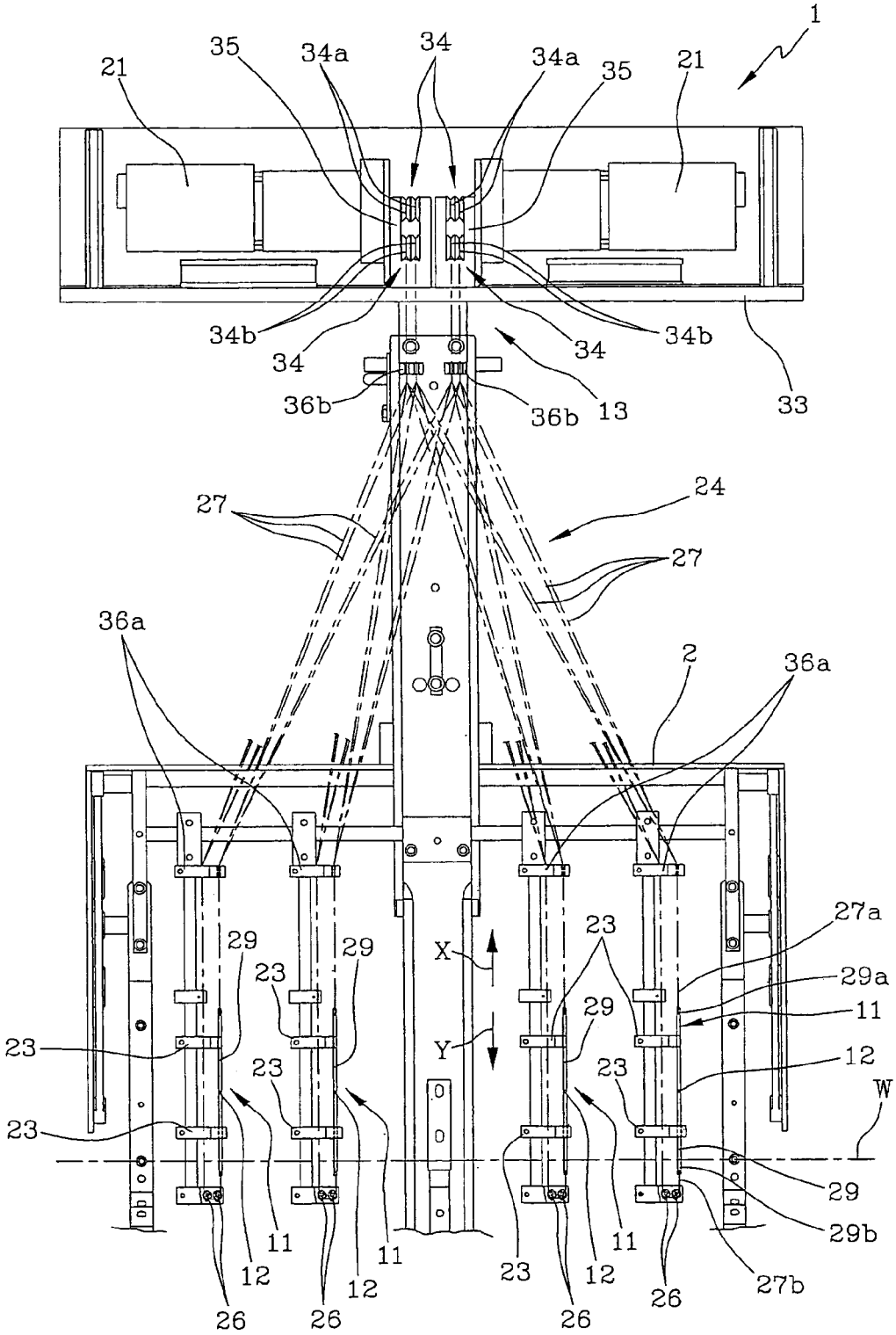
Figure 7:
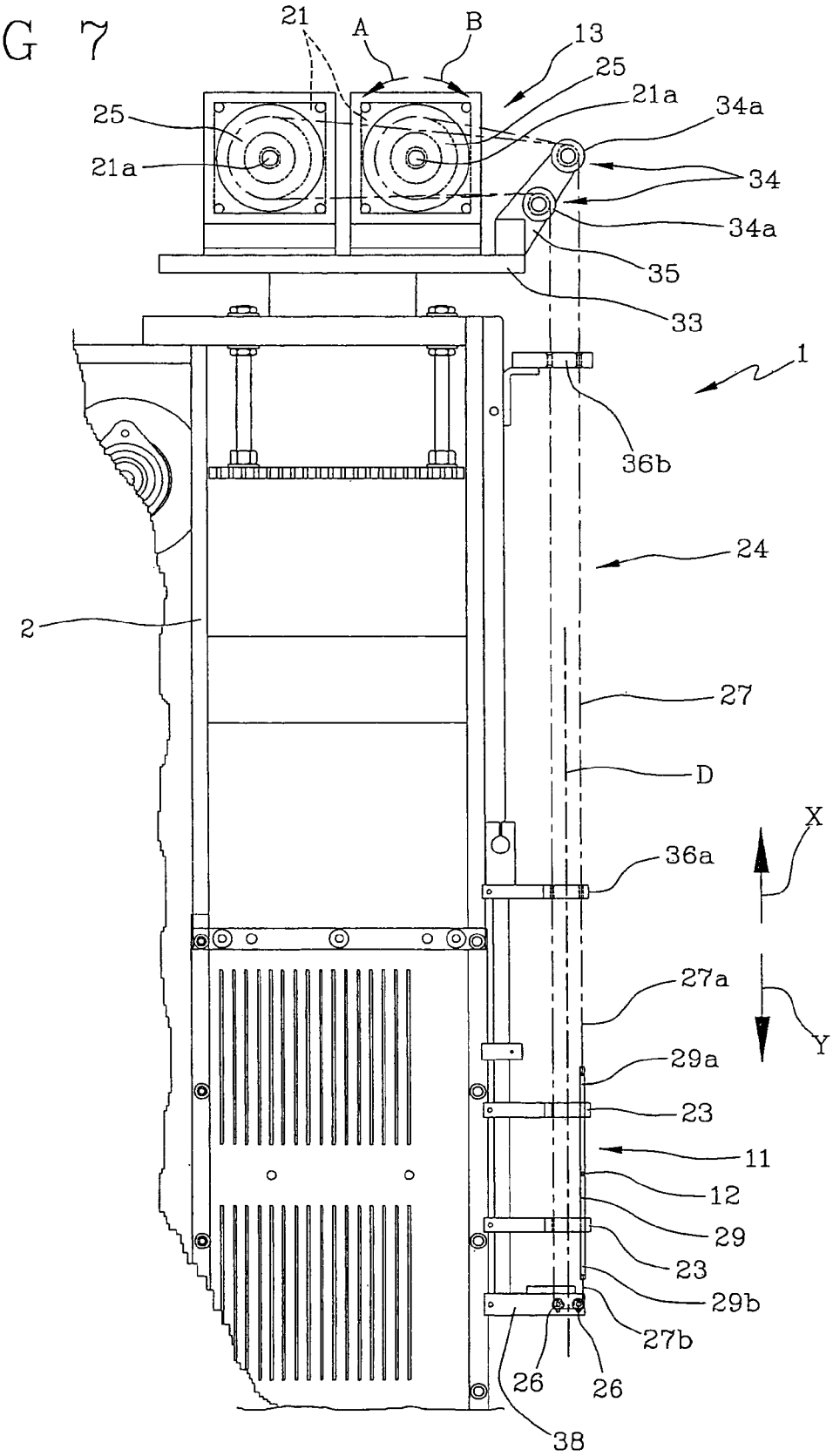
Figure 8:
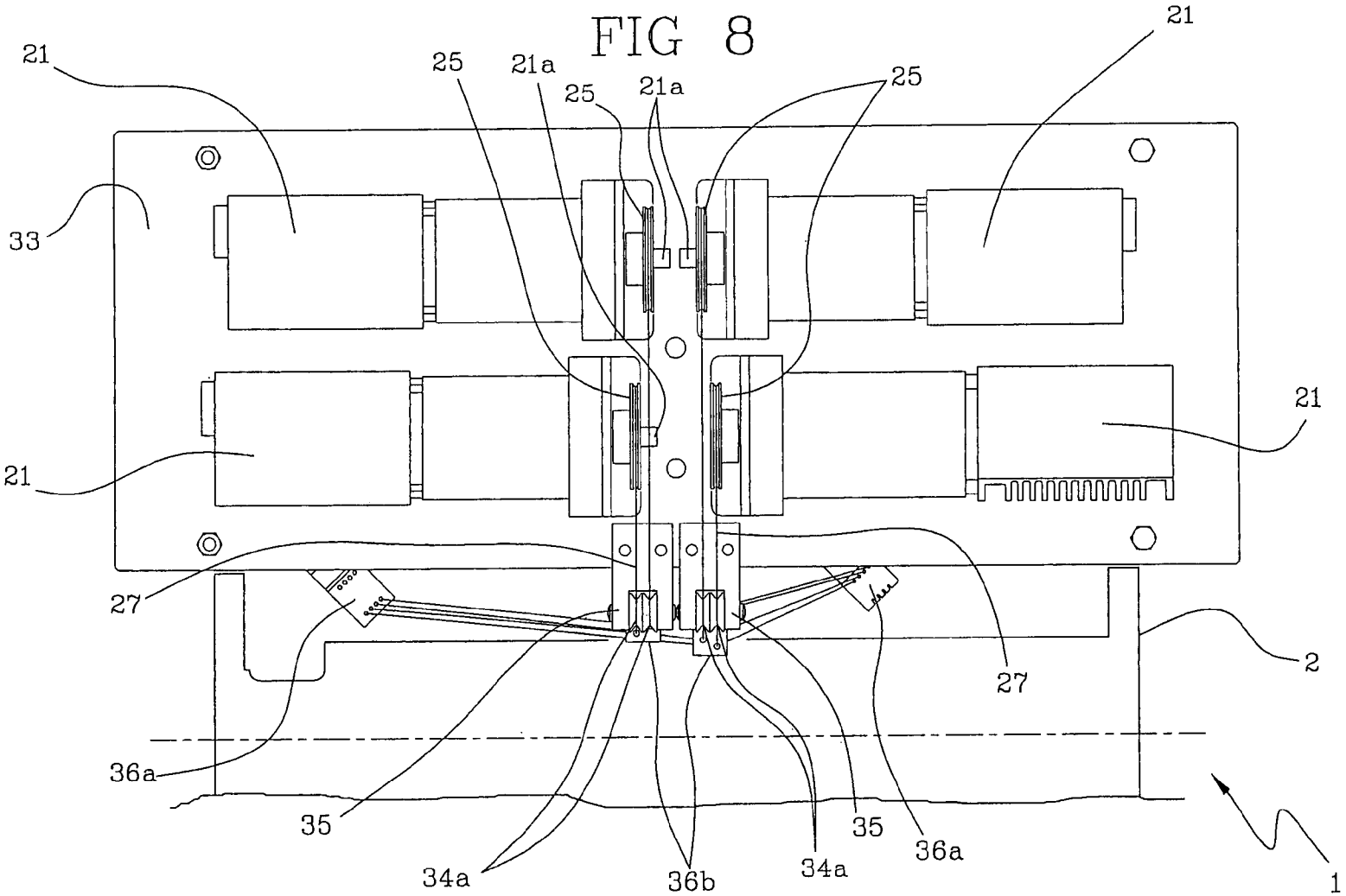
Figure 9:
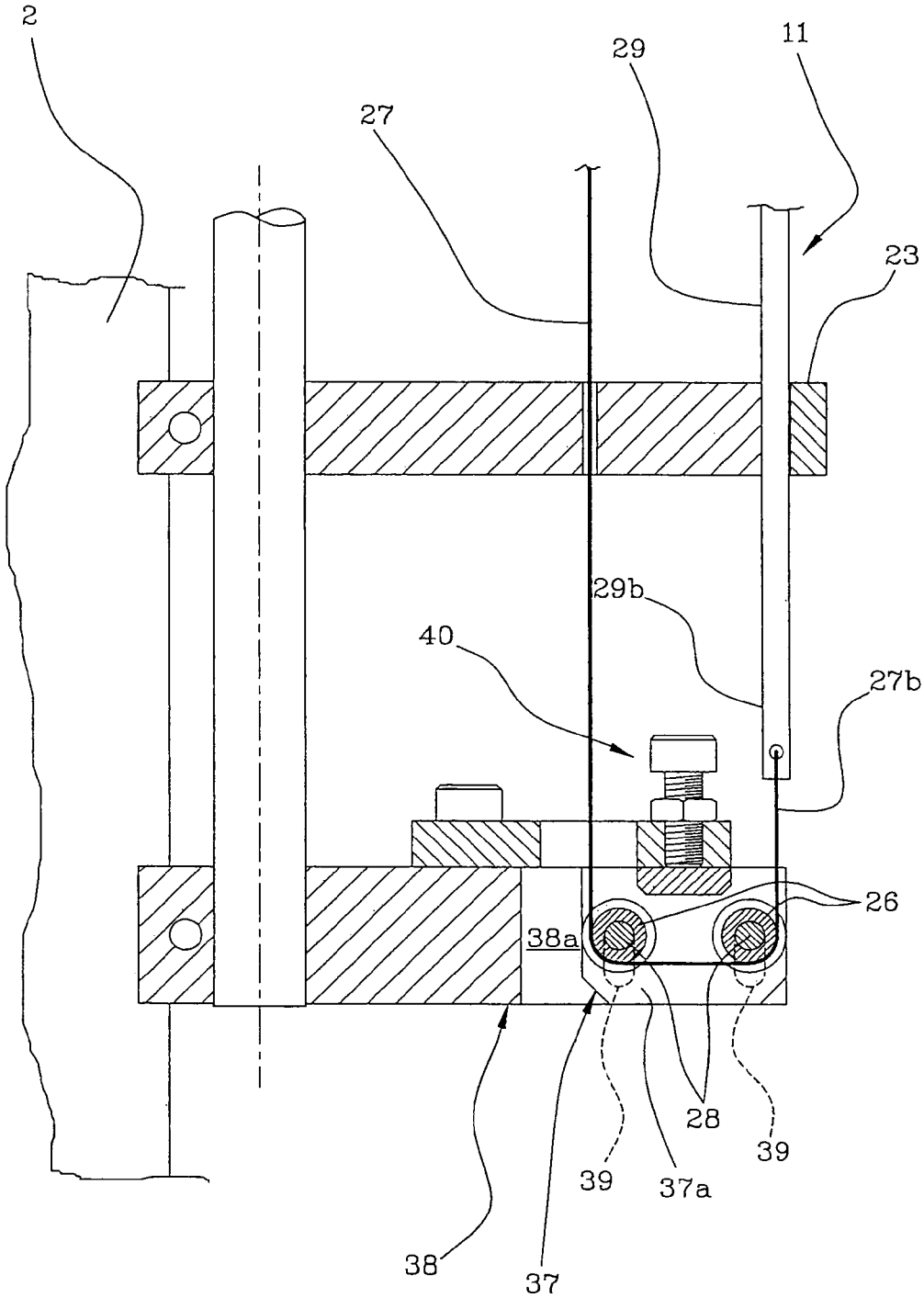

FIG. 2*a* shows a construction detail of the loom shown in FIG. 2 to an enlarged scale;

FIG. 3 is a diagrammatic side elevation view of the loom seen in FIG. 2;

FIGS. 4 and 5 shows a second and a third manufacturing solution respectively, of the loom in accordance with the present invention;

FIG. 6 is a diagrammatic front elevation view, with some parts removed for a better view of others, of a fourth embodiment of the loom in accordance with the present invention;

FIG. 7 is a diagrammatic side elevation view of the loom seen in FIG. 6;

FIG. 8 is a diagrammatic top view of the loom in FIG. 6;

FIG. 9 shows an enlarged portion of the loom seen in FIG. 7; and

FIG. 10 shows a detail of the loom seen in FIG. 7 to an enlarged scale, in a first operating position; and FIG. 11 shows the detail in FIG. 10 in a second operating position.

With reference to the drawings, a needle loom with automatic change of the weft thread in accordance with the present invention has been generally identified by reference numeral 1.

The needle loom 1 comprises a bearing structure 2 on which at least one textile-product "P" forming head 3 (depicted in detail in FIG. 1) is installed. In the accompanying drawings loom 1 has four forming heads 3 disposed in mutual side by side relationship along a predetermined axis "W", capable of simultaneously producing the same number of textile products "P" (FIGS. 2 and 6).

Figure 1:
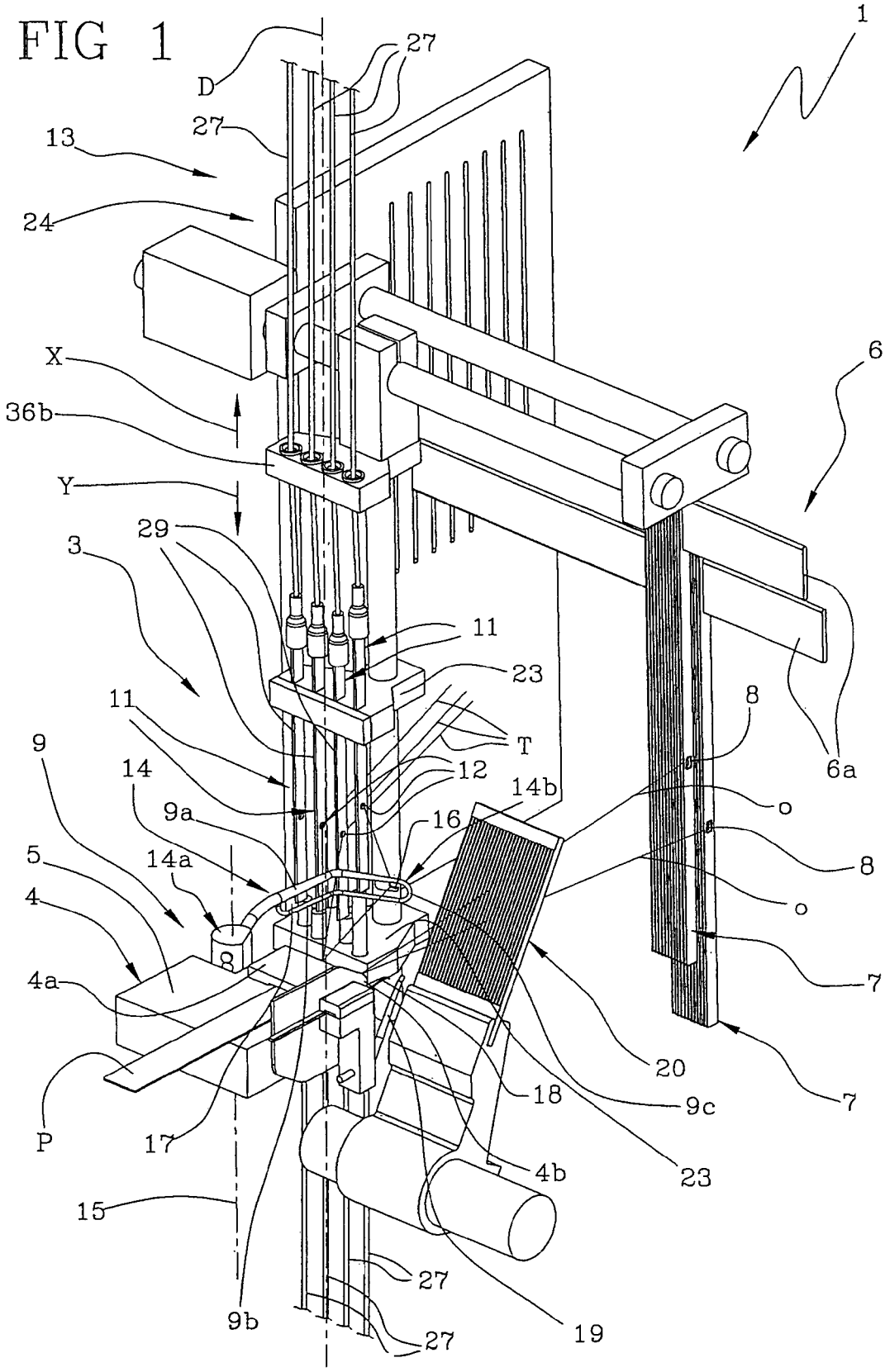
FIG. 1 is a perspective view with some parts removed for a better view of others, of a portion of a needle loom with automatic change of the weft thread in accordance with the present invention.

As better shown in FIG. 1, in accordance with a diagram of known type, the forming head 3 comprises a bearing plate 4 having a predetermined forming plane 5 on which the textile product "P" rests.

Upstream of the bearing plate 4, the forming head 3 has at least two heddle frames 6, preferably a plurality of heddle frames 6 that for the sake of clarity have been illustrated in FIG. 1 alone.

A heddle frame or harness 6 is an element capable of lifting and lowering, in a reciprocating motion, the warp threads "O" engaged by it while they are fed to the bearing plate 4. Each harness 6 comprises a plurality of heddles 7 each provided with an eye 8 through which the warp thread "O" passes. The heddles 7 are mounted on a pair of bars 6*a* (FIG. 1) moved with a reciprocating motion along a direction perpendicular to the forming plane 5. Each harness 6 engages a set of warp threads "O", of which only two are shown in FIG. 1, and is usually moved between two or three operating positions.

The heddle frames 6 can be guided by a "glider" chain or by a set of cams connected to a main drive shaft of loom 1 or by electromechanical actuators operated following pre-set programs.

The warp threads "O" come from respective beams of known type and therefore not shown, that are installed on a rack referred to as creel for example, and are fed by suitable means to the bearing plate 4 through the heddle frames 6. In particular, the warp threads "O" pass into the eyes 8 of heddles 7 of frames 6 and converge towards the forming plane 5 where they are interlooped with at least one weft thread "T" to form the textile product "P" (FIG. 1).

In more detail, the warp threads "O" intercepted by a single heddle frame 6 lie in the same plane and the planes identified by the warp threads "O" of the several different heddle frames 6 intersect at the bearing plate 4.

Downstream of the bearing plate 4, the loom 1 is provided with suitable means of known type and therefore not shown to keep the already formed textile product "P" and the warp threads "O" coming from the heddle frames 6 stretched to the proper tension, thus enabling exit of them from the loom.

The forming head 3 further comprises at least one sickle 9 alternately bringing at least two weft threads "T" transversely between the warp threads "O".

Each of the weft threads "T" is unwound from a respective bobbin mounted on a creel and is advantageously supplied to sickle 9 through feeding means (not shown) and through a respective movable guide 11 located close to the bearing plate 4.

Each movable guide 11 preferably has a structure similar to the heddle 7 of a heddle frame 6. As better described in the following, it has an eye 12 passed through by a weft thread "T" before the latter reaches sickle 9 (FIG. 1).

Each of the movable guides 11 is moved along a predetermined vertical direction "D" (FIG. 1) with a reciprocating motion preferably offset from motion of the other guides 11 through actuator means 13 shown in particular in FIGS. 2 to 8 and only partly in FIG. 1, so as to vary the height of the eyes 12 guiding the weft threads "T" and the height level of the weft threads "T" themselves.

Sickle 9 has a U-shaped arm 14 a first end 14*a* of which is hinged on an axis 15 perpendicular to the predetermined forming plane 5 and a second end 14*b* of which is provided with a hook 16 preferably of a dovetail conformation, capable of intercepting one of the weft threads "T", to bring it into engagement with the warp threads "O" close to the bearing plate 4 (FIG. 1).

Following a scheme of known type, sickle 9 carries out an alternate rotating motion according to an arc of a circle so that hook 16 cyclically moves close to and away from the warp threads "O".

In particular, hook 16 is movable between a first position at which it lies in side by side relationship with a first side end 4*a* of the bearing plate 4 and a second position at which it lies in side by side relationship with a second side end 4*b* of the bearing plate 4.

The hook 16 of sickle 9 intercepts and brings the weft thread "T" that is positioned to a predetermined height level by the respective movable guide 11, towards the second side end 4*b* of the bearing plate 4, while the other weft threads "T" located at a higher or lower position are not intercepted.

To prevent the weft threads "T" that are not engaged by hook 16 from interfering with other parts of loom 1 or, taking into account the concerned high rates, from starting vibrating, which will make it impossible for sickle 9 to intercept them in a subsequent work cycle, sickle 9 is preferably provided with two superposed arms 9*a*, 9*b* joined by an arched length 9*c* at the second end 14*b*. The two arms 9*a*, 9*b* delimit a slot 17 through which all the weft threads "T" pass irrespective of their being intercepted by hook 16 or not. In the embodiment shown, hook 16 is rigidly connected to the upper arm 9*a* and extends at the inside of slot 17.

At the second side end 4*b* of the bearing plate 4, the forming head 3 has at least one movable needle 18 the function of which is to temporarily retain the weft thread "T" brought by sickle 9 to the second position, on the end thereof, until said weft thread "T" is interlaced with the warp threads "O". Needle 18 moves relative to the bearing plate 4 between a retracted position that is close to the first position of sickle 9, and an advanced position corresponding to the second position of sickle 9. A loading device 19 disposed in side by side relationship with needle 18 is used to load the weft thread "T" on the end of the needle 18 itself.

The forming head 3 finally comprises a reed 20 the dual function of which is to keep the warp threads "O" apart and to push the weft threads "T" against the already formed textile product "P", preferably after each passage of sickle 9. Reed 20 is installed between the bearing plate 4 and harness 6 and has a series of parallel strips of wires fastened to a rigid frame. Reed 20 is movable between a disengagement position, at which it lies spaced apart from the bearing plate 4 and the formed textile product "P", and a compacted position, at which it lies close to the bearing plate 4 to force the weft thread or threads "T" to a compacted condition.

Advantageous and unlike the looms of the known art, the actuator means 13 designed to move the movable guides 11 of the weft threads "T" comprise as many electric motors 21 as the number of the movable guides 11 of a single forming head 3 (FIGS. 2 and 8). Each electric motor 21, preferably of the stepping or brushless type, is connected to a respective movable guide 11 to move it, irrespective of the other guides of the same head 3, in a first way "X" along a predetermined direction "D" upon command of the respective motor 21 or in a second way "Y", opposite to "X", along said predetermined direction "D" upon command of the same motor 21.

In particular, each motor 21 is movable between a first position at which it actively displaces the respective guide 11 in a vertical direction to move the weft thread "T" away from sickle 9, and a second position at which it actively displaces the guide 11 in a vertical direction to move the weft thread "T" close to sickle 9.

Preferably, as clearly shown in FIGS. 2 and 6, each of the electric motors 21 is connected to the homologous movable guides 11 of all heads 3. It is to be pointed out that the term "homologous guides" means the guides 11 of the different heads 3 simultaneously carrying out the same movement sequence.

In this way, all heads 3 of a single loom 1 driven by a single set of electric motors 21 work in parallel to produce identical artefacts.

According to alternative embodiments not shown, however, also a loom 1 provided with electric motors 21 specifically dedicated to the movable guides 11 of each individual head 3 and thus capable of simultaneously producing different artefacts or a loom 1 provided with a single forming head 3, fall within the scope of the present invention.

The electric motors 21 are advantageously connected to a programmable control unit 22 (only shown in FIG. 2, for the sake of simplicity), preferably a microprocessor, capable of managing moving of each movable guide 11 away from/close to sickle 9, based on specific work schedules entered by an operator.

Unit 22 is further connected to sensors, not shown as of known type, detecting at least one parameter indicating the work step of loom 1 and transmitting it to the unit 22 itself, which parameter performs the function of reference signal for said unit 22. The sensor can consist, for example, of an encoder mounted in the vicinity of the main drive shaft to detect the angular position of the shaft and the exact operating step of loom 1, at each instant. The encoder enables setting, via software, of the angular position of the main drive shaft at which intervention of the electric motors 21 and displacement of the movable guides 11 occurs.

In the embodiments shown in the accompanying drawings, the loom 1 has four forming heads 3, each provided with four movable guides 11 disposed in mutual side by side relationship and vertically slidable within fixed guide supports 23 mounted on the bearing structure 2.

In the first, second and fourth embodiments (FIGS. 2-3 and 6-10), each motor 21 has a rotating shaft 21*a* rotating in a first way "A " to actively shift the respective guide 11 upwards in the first way "X", or rotating in a second way "B" opposite to the first one "A", to actively shift the respective guide 11 downwards in the second way "Y".

Loom 1 further has motion-transmitting means 24 interposed between the shaft 21*a* of each electric motor 21 and the respective movable guide 11.

In accordance with the first (FIGS. 2, 2*a*, 3) and fourth (FIGS. 6, 7, 8, 9, 10) embodiments, the motion-transmitting means 24 comprises a driving pulley 25 connected to motor 21, at least one driven pulley 26 and a flexible transmission element 27 wound up loop-wise on the driving pulley 25 and the driven pulley 26 and carrying one of said movable guides 11.

In the first embodiment seen in FIGS. 2, 2*a* and 3 motors 21 are disposed under said movable guides and are directly supported by the bearing structure 2.

In particular, as better depicted in FIG. 2, each motor 21 has a shaft 21*a* extending transversely of the movement direction "D" of said guides 11. Motors 21 are placed upon each other in such a manner that the respective shafts are disposed mutually in parallel.

In detail, the motion-transmitting means 24 has a plurality of driving pulleys 25 fitted on the shaft 21*a* of each motor 21. More specifically, for each shaft 21*a* there are as many homologous driving pulleys 25 as the number of the forming heads 3. In the example shown in FIG. 2, in which four forming heads 3 are present, each shaft 21*a* has four driving pulleys 25. In addition, installed on top of shafts 21*a* is a plurality of fixed pins 28 mounted on the support structure 2 and parallel to the longitudinal extension of shafts 21*a*.

Rotatably mounted on said pins 28 is a plurality of driven pulleys 26, each of which is disposed close to a respective forming head 3. Each pin 28 carries the homologous driven pulleys 26, each of them being associated with one of the homologous driving pulleys 25.

In detail, pins 28 and the respective driven pulleys 26 mounted on each pin 28 are as many as the number of the forming heads 3. In the example in FIG. 2 four pins 28 and four pulleys 26 for each pin 28 are shown.

The motion-transmitting means 24 further has a plurality of flexible transmission elements 27, each of which is associated with a respective guide 11 and is looped around a respective driving pulley 25 and a respective driven pulley 26.

The movable guide 11 is made up of a support portion 29 provided with said eye 12 and extending along the vertical movement direction "D" of the guide 11 itself. The eye 12 is interposed between a first end 29*a* of the respective support portion 29 close to a respective driving pulley 25 and a second end 29*b* close to a respective driven pulley 26 (FIGS. 2 and 2*a*).

The support portion 29 is advantageously made up of a flexible cable supporting said eye 12 in the middle (FIG. 2*a*) . Alternatively, as shown in FIG. 1, the support portion 29 can consist of a rigid plate of an elongated configuration.

Each flexible element 27 is a belt or a cord connected to said support portion 29 by means of suitable junction elements known by themselves and therefore not further described in detail.

In particular,-the flexible element 27 has a first end 27*a* in engagement with the first end 29*a* of the support portion 29 and a second end 27*b* in engagement with the second end 29*b* of said support portion 29.

Therefore, the flexible element 27 together with the respective support portion 29 defines an annular structure in engagement with a respective driving pulley 25 and a respective driven pulley 26 (FIG. 3). As better shown in detail in FIG. 2*a*, the flexible elements 27 present in each head 3 have different lengths for engagement with the respective driving and driven pulleys 25, 26 that are disposed at different distances from the support element 29.

In accordance with a second embodiment diagrammatically shown in FIG. 4, the motion-transmitting means 24 consists of a plurality of cogwheels 30 fitted on the shaft 21*a* of each motor 21. In this case too, the number of the cogwheels 30 for each shaft is the same as the number of the forming heads 3 of loom 1. Each cogwheel 30 is disposed close to a respective forming head 3 and is associated with a respective movable guide 11.

In more detail, each guide 11 has a rigid rod 31 in which, at a respective median portion, said eye 12 for passage of the weft thread "T" is formed. The rod 31 extends along the movement direction "D" of guide 11 and has a rack-wise toothed end 31*a* meshing with a respective cogwheel 30. By coupling between the cogwheel 30 and rod 31, the rotary motion of each shaft 21*a* is converted into a translation motion of guide 11.

In accordance with a third embodiment shown in FIG. 5, each electric motor 21 is made up of a linear electric motor having a reciprocating translation device 32.

In particular, the translation device 32 consists of a slider of elongated shape extending along said vertical movement direction "D" of guide 11. Under this situation too, each guide 11 has a rigid rod 31 in which said eye 12 for passage of the respective weft thread "T" is formed. The rod 31 is secured to said translation device 32 of a respective motor 21 imparting motion to guide 11. In the same manner as for the first and second previously described embodiments, each of the linear motors 21 can also drive the homologous guides 11 of all heads 3.

In accordance with a fourth embodiment shown in FIGS. 6-10, each motor 21 is located on a horizontal support 33 placed at an upper end of the bearing structure 2, over the forming heads 3. Each motor 21 carries a driving pulley 25 fitted on its shaft 21*a* while the driven pulley 26 is mounted close to the forming head 3. Idler wheels 34 of the flexible transmission element 27 are connected to the horizontal support 33 and are substantially superposed on the driven pulleys 26.

In more detail, with reference to FIG. 8, the driving pulleys 25 are gathered in the middle of support 33 and they face each other two by two while the shafts 21*a* of motors 21 lie parallel to the alignment axis "W" of the forming heads 3. In addition, the driving pulleys 25 are offset to enable passage of the flexible transmission elements 27 along a substantially horizontal direction perpendicular to said alignment axis "W" (FIGS. 7 and 8). Four upper idler wheels 34*a* face each other and are rotatably mounted on brackets 35 extending from the horizontal support 33. Four lower idler wheels 34*b* facing each other are mounted on the above mentioned brackets 35 at a lower and rearward position relative to the upper idler wheels 34*a* (FIGS. 6, 7 and 8).

Each of the flexible elements 27 extends from the first end 29*a* of the support portion 29 of eye 12 until a lower guide element 36*a* (FIGS. 6 and 7) and then runs obliquely until an upper guide element 36b for junction with the homologous flexible elements 27 from the three other heads 3 (FIG. 6). For the sake of simplicity and clarity, only two lower guide elements 36*a* are shown in FIG. 8. The homologous flexible elements 27 get up as a single cable towards a respective upper idler wheel 34*a* and are deviated to one of the driving pulleys 25, on which they are partly wrapped (FIG. 7). The homologous flexible elements 27 define an arc of a circle around the respective driving pulley 25 and go back to the idler wheels 34, rest on the lower idler wheels 34*b* (FIG. 7) and deviate downward until the upper guide element 36*b*. At said upper guide element 36*b* the homologous flexible elements 27 separate and go on obliquely towards each head 3, again passing through the lower guide elements 36*a* (FIG. 6) and being partly wrapped around two driven pulleys 26 (FIG. 7), and then they go on upwards and meet the second end 29*b* of the support portion 29 of eye 12 (FIG. 7). Each forming head 3 is therefore provided with four pairs of driven pulleys 26, one pair for each guide 11.

Preferably, the driven pulleys 26 of each head 3 are mounted on an adjusting plate 37 that can be vertically shifted relative to a fixed support 38 of the loom 2 and locked to a desired position based on the length of the flexible element 27 (FIG. 9). This expedient avoids cutting of the cables in a precise manner, i.e. in the order of the millimetre, each time they are to be replaced. For instance, pins 28 of the driven wheels 26 pass through holes formed in side shoulders 37*a* of the plate 37 and through slots 39 formed in side shoulders 38*a* of the fixed support 38 and are locked by means of nuts, not shown, screwed down on ends of said pins 28. An adjusting screw 40 is used to snugly adjust the height of the plate before it is tightened by the nuts on pins 28.

Finally, each driving pulley 25 is provided with a tensioning device 41 enabling possible elasticity of the flexible element 27 to be compensated for.

In fact, during rotation of the driving pulley 25 following way "B" for the purpose of pulling the guide 11 downwards, in the second way "Y", the length of the flexible element 27 extending between the driven pulley 26 and the lower idler wheel 34*b* is surely taut while the length extending between the first end 29*a* of the support portion 29 and the upper idler wheel 34*a* can be slack, due to friction with the pulleys and to partial elasticity of the flexible element 27. Said device 41 enables elimination of this drawback.

As shown in FIGS. 10 and 11, this tensioning device 41 is defined by a peripheral portion 42 of the driving pulley 25 that can radially run in pulley 25 through two pins moving along respective slots. The device 41 is movable between a rearward position (FIG. 10), at which the peripheral edge 41*a* of said device 41 lies flush with the peripheral edge 43 of pulley 25, and a drawn out position (FIG. 11) at which the peripheral edge 41*a* of said device 41 projects beyond the peripheral edge 43 of pulley 25. At least one spring 44 is interposed between said peripheral portion 42 and the pulley 25 itself and pushes the peripheral portion 42 outwards, i.e. towards the drawn out position. The stretched taut flexible element 27 wrapped on the driving pulley 25 pushes the peripheral portion 42 towards the rearward position against the action of spring 44. When a length of the flexible element 27 tends to become slack, spring 44 moves said peripheral portion 42 towards the drawn out position so that the correct tension is restored.

In use, in a first operating step of the needle loom 1, while two sets of warp threads "O" are maintained spaced apart from the two heddle frames 6, sickle 9 is in the first position with hook 16 disposed in side by side relationship with the first side end 4*a* of the bearing plate 4. Needle 18 is retracted and temporarily retains the weft thread "T", the loading device 19 being in the lowered position and reed 20 being in the compacting position.

At this point, the heddle frames 6, moved in opposite ways, cause crossing of the two warp thread "O" sets and interlacing with the weft thread "T".

Reed 20 moves to the disengagement position and enables shifting of sickle 9 to the second position, close to the second side end 4*b* of the bearing plate 4.

During this movement, the hook 16 of sickle 9 engages the weft thread "T" that at that instant reaches the predetermined intercepting height level being retained by one of the movable guides 11.

The other weft threads "T" passing in the movable guides 11 and being positioned at higher or lower locations are not intercepted.

Simultaneously, needle 18 moves to the advanced position and releases the already interlaced weft thread "T", being ready to retain the weft thread "T" brought again close thereto by sickle 9.

Before sickle 9 goes back to the first position, the loading device 19 rises and hooks the weft thread "T" to needle 18 during the return stroke of the latter to the retracted position. Once sickle 9 has gone back to the first position, the reed 20 moves towards the bearing plate 4 to carry out compacting of the new weft row.

At this point, a new operating cycle for execution of a subsequent weft row begins. According to the previously set schedule, the control unit 22 operates the electric motors 21 to make them shift the movable guides 11 and lead the same weft thread or a different weft thread "T" to pass or stop at the interception height level during moving forward of sickle 9.

In accordance with the first embodiment (FIGS. 1 to 3), motors 21 cause rotation of the driving pulleys 25 mounted on the respective shafts 21*a* to impart a reciprocating linear movement to the flexible element 27 and guide 11. Movement of motor 21 in the first "A" and second "B" rotation ways defines positioning of guide 11 relative to sickle 9. In this connection, it is to be pointed out that each guide 11 can be disposed at any position, during both the upward movement and downward movement, because motor 21 controls the respective guide 11 always in an active manner during shifting along the vertical direction "D".

All movements of the above described elements are electronically managed by the control unit 22 to enable them to take place in synchronism, following the described operating schedule.

Likewise, in the example shown in FIG. 4, rotation of the cogwheel 30 in the two ways causes a to-and-fro movement of rod 31.

In the embodiment in FIG. 5, the translation device 32 movable along the movement direction "D" of guide 11, causes displacement of the guide 11 itself.

Operation of the fourth embodiment shown in FIGS. 6-10 is the same as that of the first embodiment.

At all events, irrespective of the motion-transmitting means 24 adopted in the specific technical solutions, the basic idea of the present invention consists of the active control that motor 21 exerts on guide 11 during both the upward and downward movements, which active control eliminates the necessity to adopt passive return elements, such as springs. In other words, the system consisting of guide 11, motor 21 and the motion-transmitting means 24 is of the type provided with one degree of freedom alone. In the first and fourth embodiments (FIGS. 2-3 and 6-10), motor 21 pulls guides 11 upwards and pulls guides 11 downwards. In the embodiments in FIGS. 4 and 5, motor 21 pulls guides 11 downwards and pushes them upwards.

The textile product "P" obtained with the present needle loom is formed of a succession of weft rows consisting of different weft threads "T" interlaced with the warp threads "O". The weft threads "T" used can be of different materials or merely of different colours.

Finally, it will be appreciated that, as an alternative solution to the sickle of the above described type as regards both structure and operation, the loom being the object of the invention can have other types of sickles, known by themselves, that, while working in a slightly different manner from the one detailed above, at all events enable at least two weft threads "T" to be brought transversely, in an alternating manner, between the warp threads "O".

The invention achieves important advantages.

The needle loom with automatic change of the weft thread in accordance with the present invention is much more versatile than the looms of the known art.

In fact, movement of the movable guides 11 carrying the weft thread "T" is controlled at any instant and in the two motion ways. Advantageously, the movement speed of each guide 11 is controlled and checked during both the upward motion and during the downward motion. In addition, the guide height level at which the weft thread is intercepted by the sickle can be modified each time depending on current requirements. Finally, the loom 1 is very reliable, in particular as compared with the looms of the known art provided with return springs. In fact, the working speed is no longer limited by the all problems encountered when said springs are adopted.

The invention claimed is:

1. A needle loom with automatic change of the weft thread, comprising:

a bearing structure (2);

at least one textile-product (P) forming head (3) installed on the bearing structure (2), said head (3) having a bearing plate (4) for formation of the textile product (P);

at least two heddle frames (6) for intercepting a plurality of warp threads (O) fed to the bearing plate(4);

at least one sickle (9) to bring at least two weft threads (T) transversely between said warp threads (O);

at least two movable guides (11) each of which is adapted to guide one of the weft threads (T) supplied to the sickle (9);

actuator means (13) to move said at least two movable guides (11) along a predetermined direction (D) and change the weft threads (T) carried by the sickle (9);

at least one needle (18) to temporarily retain at least one of said at least two weft threads (T) carried by the sickle (9); and a reed (20) movable between a release position and a compacting position, to compact the weft threads (T) against the already formed textile product (P);

wherein the actuator means (13) comprises at least two electric motors (21), each of which is connected to a respective guide (11), and motion-transmitting means (24) interposed between each electric motor (21) and the respective movable guide;(11)

wherein each motor (21) pulls or pushes the respective guide (11) downwards and pulls or pushes the respective guide (11) upwards, to actively move the respective guide (11) in a first way (X) along the predetermined direction (D), upon command of the respective motor (21) and actively move the respective guide (11) in a second way (Y) along said predetermined direction (D), upon command of said motor (21).

2. A loom as claimed in claim 1, characterized in that each motor (21) has a shaft (21*a*) rotating in a first way (A) to actively move the respective guide (11) in the first way (X), or rotating in a second way (B) opposite to the first one (A), to actively move the respective guide (11) in the second way (Y).

3. A loom as claimed in claim 1, characterized in that the motion-transmitting means (24) comprises a driving pulley (25) connected to the motor (21), at least one driven pulley (26) and a flexible transmission element(27) passing over the driving pulley (25) and said at least one driven pulley (26) and carrying one of said movable guides (11).

4. A loom as claimed in claim 3, characterized in that each movable guide (11) is a flexible cable provided with an eye (12) for passage of the weft thread (T).

5. A loom as claimed in claim 3, characterized in that each movable guide (11) is a rigid rod having an eye(12) for passage of the weft thread (T).

6. A loom as claimed in claim 1, characterized in that said motion-transmitting means (24) comprises a cogwheel (30) fitted on the shaft (21*a*) of a respective motor (21) and disposed close to a respective forming head (3); each movable guide (11) comprising a rigid rod (31) having a toothed end (31*a*) meshing with a respective cogwheel (30).

7. A loom as claimed in claim 1, characterized in that each electric motor (21) is a linear electric motor having a translation device (32) movable in a reciprocating manner; each guide (11) comprising a rigid rod (31) mounted on the translation device (32) of a respective motor (21).

8. A loom as claimed in claim 1, characterized in that it comprises a plurality of forming heads (3) and in that each of said electric motors (21) is connected to the homologous movable guides (11) of all heads (3).

9. A loom as claimed in claim 1, characterized in that it comprises a programmable control unit (22) operatively connected to said electric motors (21) to manage displacement of each movable guide (11) both in one way (X) and in the other way (Y).

10. A loom as claimed in claim 3, characterized in that the shaft (21*a*) of each motor (21) extends horizontally under said forming head (3) and carries the driving pulley (25), and in that the motion-transmitting means(24) further comprises a pin (28) fixedly mounted on the forming head (3) and parallel to the longitudinal extension of the shaft (21*a*) of the motor (21); the driven pulley (26) being rotatably mounted on said pin (25).

11. A loom as claimed in claim 10, characterized in that it comprises a plurality of forming heads (3), and in that each shaft (21*a*) carries a plurality of homologous driving pulleys (25), each of them being associated with one of said forming heads (3).

12. A loom as claimed in claim 11, characterized in that each pin (25) carries a plurality of homologous driven pulleys (26) each of which is associated with one of said forming heads (3) and with one of the homologous driving pulleys (25).

13. A loom as claimed in claim 3, characterized in that each motor (21) is located on a horizontal support (33) mounted on top of the forming heads (3) and carries a driving pulley (25) fitted on its shaft (21*a*).

14. A loom as claimed in claim 13, characterized in that said at least one driven pulley (26) is mounted close to the forming head (3), and in that the motion-transmitting means (24) further comprises idler wheels(34) of the flexible transmission element (28) that are connected to the horizontal support (33) and substantially placed above at least one driven pulley(26).

15. A needle loom with automatic change of the weft thread, comprising:

a bearing structure (2);

at least one textile-product (P) forming head (3) installed on the bearing structure (2), said head (3) having a bearing plate (4) for formation of the textile product (P);

at least two heddle frames (6) for intercepting a plurality of warp threads (O) fed to the bearing plate (4);

at least one sickle (9) to bring at least two weft threads (T) transversely between said warp threads (O);

at least two movable guides (11) each of which is adapted to guide one of the weft threads (T) supplied to the sickle (9);

actuator means (13) to move said at least two movable guides (11) along a predetermined direction (D) and change the weft threads (T) carried by the sickle (9);

at least one needle (18) to temporarily retain at least one of said at least two weft threads (T) carried by the sickle (9); and a reed (20) movable between a release position and a compacting position, to compact the weft threads (T) against the already formed textile product (P);

wherein the actuator means (13) comprises at least two electric motors (21), each of which is connected to a respective guide (11), and motion-transmitting means (24) interposed between each electric motor (21) and the respective movable guide (11);

wherein each motor (21) pulls or push the respective guide (11) downwards and pull or push the respective guide (11) upwards, to actively move the respective guide (11) in a first way (X) along the predetermined direction (D), upon command of the respective motor (21) and actively move the respective guide (11) in a second way (Y) along said predetermined direction (D), upon command of said motor (21), without adopting passive return elements.

* * * * *